US008127696B2

(12) United States Patent
Reed et al.

(10) Patent No.: US 8,127,696 B2
(45) Date of Patent: Mar. 6, 2012

(54) BLOCK PEDESTAL HAVING SLIDABLY SUPPORTED HORIZONTAL MEMBERS

(75) Inventors: Petra Reed, Redwood City, CA (US); James P. Reed, Redwood City, CA (US)

(73) Assignee: Pedestal Designs Inc., Menlo Park, CA (US)

( * ) Notice: Subject to any disclaimer, the term of this patent is extended or adjusted under 35 U.S.C. 154(b) by 383 days.

(21) Appl. No.: 11/732,215

(22) Filed: Apr. 2, 2007

(65) Prior Publication Data

US 2007/0284322 A1 Dec. 13, 2007

Related U.S. Application Data

(60) Provisional application No. 60/789,548, filed on Apr. 4, 2006, provisional application No. 60/789,537, filed on Apr. 4, 2006.

(51) Int. Cl.

| | |
|---|---|
| ***A47B 55/00*** | (2006.01) |
| ***A47B 13/04*** | (2006.01) |
| ***A47B 47/04*** | (2006.01) |
| ***A47G 29/00*** | (2006.01) |

(52) U.S. Cl. ..... 108/181; 108/140; 108/158.12; 248/346.02; 248/678; 211/189

(58) Field of Classification Search ..... 52/666, 52/668; 108/91, 102, 181, 139, 140, 158.12; 248/346.01, 346.02, 676, 678; 211/189
See application file for complete search history.

(56) References Cited

U.S. PATENT DOCUMENTS

| | | | | | |
|---|---|---|---|---|---|
| 243,567 | A | | 6/1881 | Ireland | |
| 554,661 | A | | 2/1896 | Doolittle | |
| 1,214,928 | A | * | 2/1917 | Lachman | 52/668 |
| 1,298,762 | A | | 4/1919 | Milligan | |
| 1,443,420 | A | | 1/1923 | Lennox | |
| 2,119,821 | A | | 6/1938 | Manley | |
| D118,463 | S | | 1/1940 | West | |
| 3,176,676 | A | | 4/1965 | Caldwell | 126/25 |
| 3,297,166 | A | * | 1/1967 | Summers | 211/60.1 |
| 3,538,862 | A | | 11/1970 | Patriarca | 108/59 |
| D221,781 | S | | 9/1971 | Calgan | D6/3 |
| 3,858,495 | A | | 1/1975 | Gotwalt | 99/421 HH |
| 4,408,741 | A | * | 10/1983 | Mimura et al. | 248/68.1 |
| 4,409,770 | A | * | 10/1983 | Kawaguchi et al. | 52/666 |
| D287,677 | S | | 1/1987 | Pomeroy et sl. | D6/449 |
| 4,760,802 | A | | 8/1988 | Leong | 108/157 |
| 4,761,930 | A | * | 8/1988 | Tepera | 52/669 |
| 4,955,490 | A | | 9/1990 | Schafer | 211/187 |
| D321,101 | S | | 10/1991 | Zucker | D6/479 |
| D328,536 | S | | 8/1992 | Ma | D6/460 |
| 5,269,231 | A | | 12/1993 | Johnson | 108/23 |
| 5,353,716 | A | | 10/1994 | Wilbert | 108/150 |
| 5,425,198 | A | | 6/1995 | Coy | 47/18 |
| 5,425,314 | A | | 6/1995 | MacFarland | 108/51.3 |
| 5,463,786 | A | * | 11/1995 | Mangone et al. | 14/73 |

(Continued)

*Primary Examiner* — Michael Safavi

(74) *Attorney, Agent, or Firm* — T. H. P. Richardson

(57) ABSTRACT

A pedestal comprising (i) a pedestal base whose upper surface defines at least two pairs of open channels, (ii) horizontal lower support members placed in the channels, and (iii) at least one block component which is fitted slidably over one or more of the lower support members. Two or more block components can be used together, and upper support members can be placed in channels in the upper surfaces of the block components so that they are at right angles to the lower support members. The pedestals are particularly useful in the catering and hospitality industry for supporting food and beverage containers, tableware, flower vases and sculptures.

17 Claims, 6 Drawing Sheets

U.S. PATENT DOCUMENTS

| | | | | | |
|---|---|---|---|---|---|
| 5,628,415 | A | * | 5/1997 | Mulholland | 211/189 |
| 5,829,602 | A | | 11/1998 | St. John Danko | 211/13.1 |
| 5,842,425 | A | | 12/1998 | Van der Aa | 108/64 |
| 5,887,513 | A | | 3/1999 | Fielding et al. | 99/421 A |
| 5,941,179 | A | * | 8/1999 | Herring | 108/57.19 |
| 5,996,819 | A | | 12/1999 | Klein | 211/85.14 |
| 5,996,820 | A | | 12/1999 | Broadnax | 211/85.4 |
| 6,039,192 | A | | 3/2000 | Hollander | 211/186 |
| 6,158,360 | A | | 12/2000 | Cheng | 108/103 |
| 6,182,841 | B1 | | 2/2001 | Klein | 211/85.14 |
| D446,043 | S | | 8/2001 | Stoppenhagen et al. | D6/396 |
| 6,314,869 | B1 | | 11/2001 | Bourgeois, Jr. | 99/340 |
| D453,372 | S | | 2/2002 | Pecoskie | D23/332 |
| 6,505,804 | B1 | | 1/2003 | Francis et al. | |
| 6,688,573 | B2 | | 2/2004 | Reed | 248/346 |
| 6,877,442 | B2 | | 4/2005 | Helle | 108/147 |
| 6,915,994 | B2 | | 7/2005 | Oddsen | |
| 7,407,144 | B2 | | 8/2008 | Reed | 248/346 |
| 2004/0124324 | A1 | | 7/2004 | Reed | 248/346 |
| 2006/0096508 | A1 | * | 5/2006 | Herring | 108/54.1 |

* cited by examiner

FIG. 20
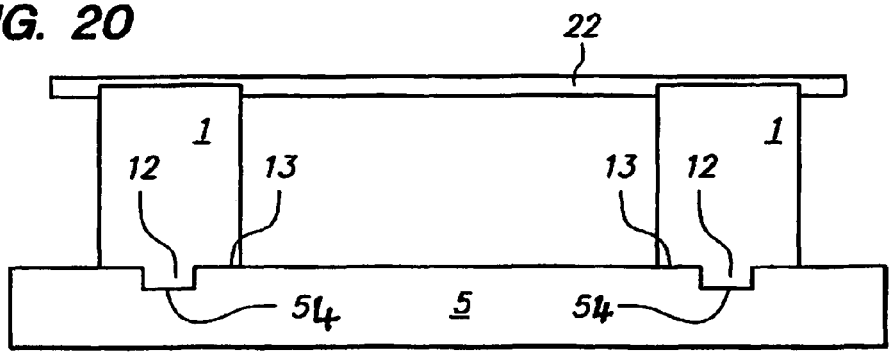
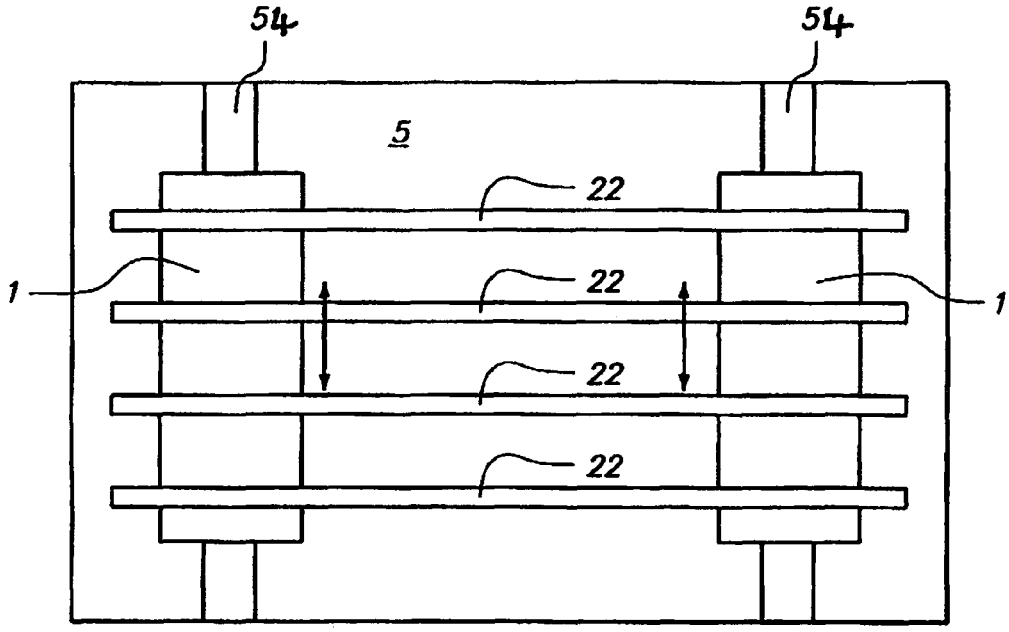
FIG. 21
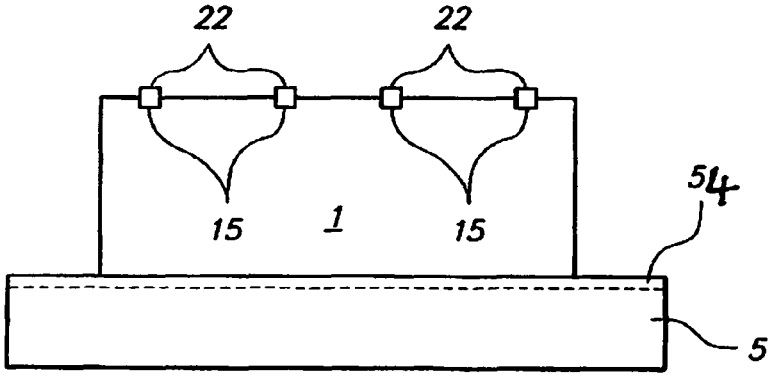
FIG. 22

BLOCK PEDESTAL HAVING SLIDABLY SUPPORTED HORIZONTAL MEMBERS

CROSS-REFERENCE TO RELATED APPLICATIONS

This application claims priority from Provisional Application No. 60/789,548, filed Apr. 4, 2006, and is related to (1) copending, commonly assigned application Ser. No. 10/734,868, filed Dec. 12, 2005, which was published as US Publication No. 2004/0124324, (2) application Ser. No. 10/117,686, filed Apr. 5, 2003, now U.S. Pat. No. 6,688,573, and (3) application Ser. No. 09/905,702, filed Aug. 2, 2001, now abandoned. This application is also related to the copending, commonly assigned, application filed contemporaneously with this application by Petra Reed which claims priority from U.S. Provisional Application No. 60/789,537, filed Apr. 4, 2006, and which is entitled Rotatable Pedestal. The disclosure of each of the above-identified applications, publication and patent is incorporated herein by reference for all purposes.

BACKGROUND OF THE INVENTION

This invention relates to pedestals. The term "pedestal" is used herein to denote a structure which can be placed on a surface, often a horizontal surface, for example on the earth, on the floor of a building, or on an elevated surface (for example a buffet or other table, sideboard or desk) and which will support objects (e.g. tableware of all kinds, foodstuffs for consumption, and other objects being displayed for commercial and/or aesthetic purposes) placed on top of, or at intermediate levels of, the pedestal. For example, pedestals are used in the catering and hospitality industry to support serving dishes, containers, platters, trays, jugs, glasses, bottles, cutlery, ice sculptures and flower vases at positions chosen for functional and/or decorative reasons.

Publication No. US 2004/0124324 discloses pedestals comprising a pedestal base and a plurality of parallel support members slidably fitted into channels in the upper surface of the pedestal base. The pedestal base can for example be (i) a hollow tube having the channels in its upper periphery, (ii) two or more separate or interlocking wall members which together provide the channels, or (iii) a single member having an undulating upper surface, the upper surface having the channels therein, and the undulations being such that the upper surface of the member, viewed from the side, is horizontal or corrugated.

SUMMARY OF THE INVENTION

We have discovered, in accordance with the present invention, novel pedestals, and novel pedestal components which are useful for making the novel pedestals and for other purposes. The invention includes novel kits comprising components which can be assembled to make the novel pedestals; methods for making the novel pedestals; and methods of displaying objects on the novel pedestals.

In normal use, the pedestals of the invention comprise one or more generally vertical members and one or more generally horizontal members. The references herein to vertical, horizontal, top, bottom, upper and lower assume that the pedestal is being used normally. However, the invention includes the possibility that the pedestal is in a different orientation, and the terms vertical and horizontal are used to include variations from the strictly vertical and strictly horizontal directions which do not have any substantial effect on the function of the components in question.

In a first preferred aspect, this invention provides a novel pedestal which comprises (1) a pedestal base having a horizontal upper surface which defines at least two pairs of open channels (referred to herein, for identification purposes, as "base channels"), each pair of base channels being sized and spaced so that a straight support member of constant cross section (referred to herein, for identification purposes, as a "lower support member") can be slidably fitted into the pair of base channels, with a midsection of the lower support member lying between the base channels and having an open space underneath it, and the pairs of base channels being placed so that, when a lower support member is fitted into each pair of base channels, the lower support members are horizontal and parallel to each other;

(2) a plurality of horizontal lower support members, each lower support member being slidably fitted into one of the pairs of base channels; and (3) a component (referred to herein, for identification purposes, as a "block component") which has (i) a substantially constant, generally rectangular core cross-section (as hereinafter defined), and (ii) top and bottom surfaces, the bottom surface comprising at least one recessed section and at least one projecting section, the recessed and projecting sections being shaped and located so that the block component fits slidably over at least one of the lower support members.

In a second preferred aspect, this invention provides a novel component which is suitable for use as a block component in a pedestal according to the first aspect of the invention, the component having (i) a substantially constant, generally rectangular core cross-section (as hereinafter defined), and (ii) top and bottom surfaces, the bottom surface comprising at least one recessed section and at least one projecting section, the recessed and projecting sections being shaped and located so that the bottom surface can be slidably fitted over at least one straight horizontal support member, or can be slidably fitted into a horizontal open channel in a component of a pedestal, and the top surface comprising at least one recessed section and at least one projecting section, the recessed and projecting sections being shaped and located so that at least one straight horizontal support member can be slidably fitted over or into the top surface.

In some embodiments, the top surface comprises a plurality of open channels (referred to herein, for identification purposes as "block channels") which are shaped and located so that horizontal upper straight support members can be placed parallel to each other in the channels. Preferably, all the block channels have the same dimensions. Preferably, the block channels are equally spaced from each other. In some embodiments, the upper surface is a mirror image (about the horizontal plane) of the inner surface, or such a mirror image which has been laterally displaced (for example, if both surfaces comprise channels, the channels in the upper surface can be directly over the channels in the lower surface, or can be staggered in relation to the channels in the lower surface).

These novel block components are also useful for other purposes, for example as part of a pedestal comprising (1) a pedestal having an upper surface comprising a plurality of straight parallel support members which are fixed to a pedestal base, (2) first and second block components according to the second aspect of the invention, each of said block components being fitted over at least one of the support members, and (3) at least two straight upper support members, each upper support member being slidably fitted into (i) one of the open channels in the first block component and (ii) one of the open channels in the second block component.

In a third preferred aspect, this invention provides a novel pedestal which comprises (1) a pedestal base which comprises
  (a) a component (referred to herein, for identification purposes, as a "base component") which has
    (i) a substantially constant, generally rectangular core cross-section having a horizontal width w, and a height h, w being at least 10 times h,
    (ii) a horizontal dimension, l, measured at right angles to the width, which is at least 10 times h and is the same as or different from w, and
    (iii) a horizontal upper surface which includes a plurality of straight open channels (referred to herein, for identification purposes, as "base channels"), and/or straight projections (referred to herein, for identification purposes, as "base projections"); and
  (b) a plurality of components (which are referred to herein, for identification purposes, as "auxiliary components", and which can optionally be block components as used in the first preferred aspect of the invention), each of the auxiliary components having a horizontal top surface and a horizontal bottom surface, the bottom surface being fitted slidably into one of the base channels or over one of the base projections, and the top surface comprising a plurality of open channels (referred to herein, for identification purposes, as "auxiliary channels") shaped and located so that a plurality of straight support members (referred to herein, for identification purposes as "auxiliary support members.") can be placed horizontally and parallel to each other in the auxiliary channels; and (2) a plurality of horizontal auxiliary support members, each auxiliary support member being slidably fitted into a first auxiliary channel in one of the auxiliary components and a second auxiliary channel in another auxiliary component.

In a fourth preferred aspect, this invention provides a novel pedestal component as defined in the third preferred aspect of the invention. These novel base components are also useful for other purposes, for example to provide the base of a pedestal which is not as defined in the third preferred aspect of the invention.

In a fifth preferred aspect, this invention provides kits containing components for assembling one or more pedestals as defined in the first preferred aspect of the invention and/or one or more pedestals as defined in the third preferred aspect of the invention, for example a kit comprising a pedestal base as defined in the first preferred aspect of the invention, a plurality of straight support members as defined in the first preferred aspect of the invention, and a block component as defined in the first preferred aspect of the invention.

In a sixth preferred aspect, this invention provides a method of making a pedestal, the pedestal being (1) a pedestal as defined in the first preferred aspect of the invention, and/or (2) a pedestal as defined in the third preferred aspect of the invention, and/or (3) a pedestal comprising a block component as defined in the second preferred aspect of the invention, and/or (4) a pedestal comprising a base component as defined in the fourth preferred aspect of the invention. The method comprises placing, preferably manually placing, the pedestal components together, in a desired configuration. Preferably the components are secured to each other only by gravitational forces (including the weight of any objects placed on the pedestal).

In a seventh preferred aspect, this invention provides a method of displaying objects which comprises placing, preferably manually placing, the objects on a pedestal, the pedestal being (1) a pedestal as defined in the first preferred aspect of the invention, and/or (2) a pedestal as defined in the third preferred aspect of the invention, and/or (3) a pedestal comprising a block component as defined in the second preferred aspect of the invention, and/or (4) a pedestal comprising a base component as defined in the fourth preferred aspect of the invention.

BRIEF DESCRIPTION OF THE DRAWINGS

The invention is illustrated by the accompanying drawings, which are diagrammatic and not to scale, and in which

FIGS. 20-22 are side, plan and end views of the upper part of a pedestal according to the third preferred aspect of the invention

DETAILED DESCRIPTION OF THE INVENTION

Figure 1:
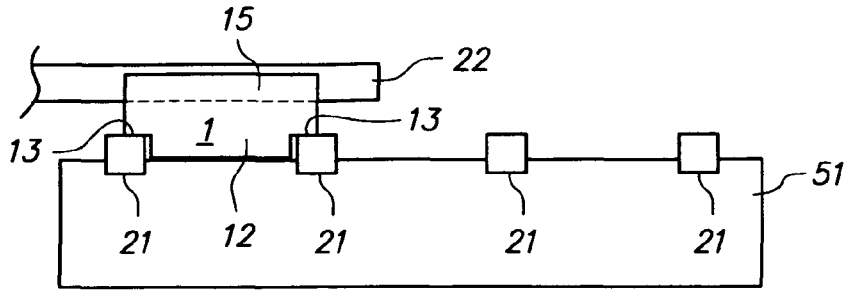
FIGS. 1-4 are end views of four different block components according to the second preferred aspect of the invention, each of the components being slidably fitted over a first set of lower support members and having upper support members located in channels in the top surface of the component. The lower support members (which are shown in cross section) are fitted into base channels over a pedestal base.
Figure 2:
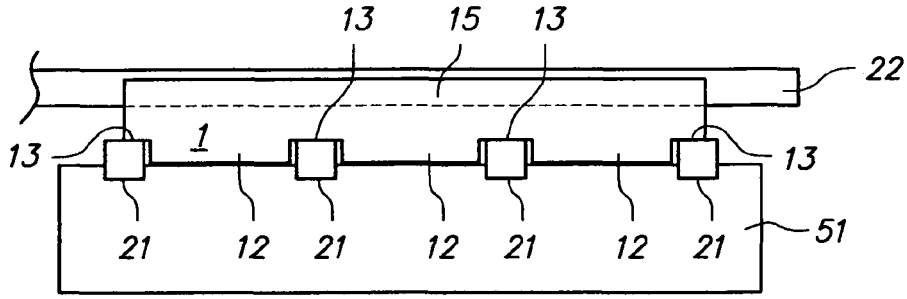
Figure 3:
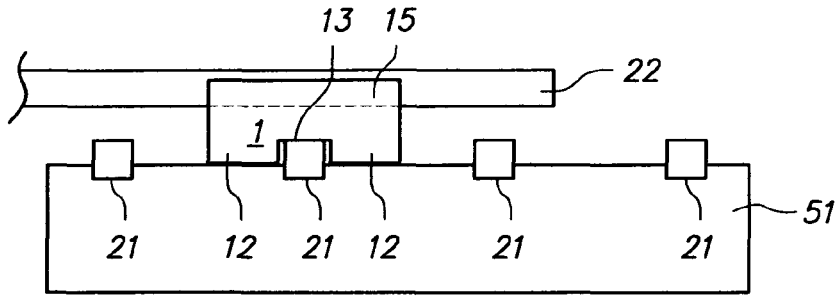

In the Summary of the Invention above, and in the Detailed Description of the Invention, and in the accompanying drawings, reference is made to particular features (including method steps) of the invention. It is to be understood that the disclosure of the invention in this specification includes all possible combinations of such particular features. For example, where a particular feature is disclosed in the context of a particular aspect, a particular embodiment, or a particular Figure, that feature can also be used, to the extent appropriate, in the context of other particular aspects, embodiments, and Figures, and in the invention generally.

The term "comprises" and grammatical equivalents thereof are used herein to mean that other elements (i.e. components, ingredients, steps etc.) are optionally present. For example, a pedestal "comprising" (or "which comprises") components A, B and C can contain only components A, B and C, or can contain not only components A, B and C but also one or more other components. The term "at least" followed by a number is used herein to denote the start of a range beginning with that number (which may be a range having an upper limit or no upper limit, depending on the variable being defined). For example "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4. When, in this specification, a range is given as "(a first number) to (a second number)" or "(a first number)–(a second number)", this means a range whose lower limit is the first number and whose upper limit is the second number. For example, "from 8 to 20 inches" or "8-20 inches" means a range whose lower limit is 8 inches, and whose upper limit is 20 inches. The terms "plural" and "plurality" are used herein to denote two or more than two items.

Where reference is made herein to "first" and "second" elements, this is generally done for identification purposes; unless the context requires otherwise, the first and second elements can be the same or different, and reference to a first element does not mean that a second element is necessarily present (though it may be present). Where reference is made herein to "a" or "an" element, this includes the possibility that there are two or more such elements (except where the context excludes that possibility). Where reference is made herein to two or more elements, this includes the possibility that the two or more elements are replaced by a lesser number or greater number of elements providing the same function (except where the context excludes that possibility). The numbers given herein should be construed with the latitude appropriate to their context and expression; for example, each number is subject to variation which depends on the accuracy with which it can be measured by methods conventionally used by those skilled in the art.

Some of the components used in this invention are defined as having "a substantially constant generally rectangular core cross-section". Those components are also defined as having recessed and projecting sections and/or channels in their top and/or bottom surfaces. The term "core cross-section" is used herein to denote the largest-area cross-section which can be drawn by four straight lines within the actual cross-section of the component. The term "generally rectangular core cross-section" is used herein to denote any core cross-section which has a closed perimeter and which is rectangular or which provides the same functionality as a rectangular cross-section. Thus, the generally rectangular core cross-section can, for example, be a square; a rectangle whose height is substantially greater than, e.g. at least twice, its width; a rectangle whose height is substantially less than, e.g. less than 0.5 times, its width; a parallelogram; a trapezium; or a circle or an oval which has been modified so that the cross-section has flat top and bottom surfaces. The component can be solid, or it can contain one or more voids. The term "substantially constant" in the term "substantially constant generally rectangular core cross-section" means that the cross-section is constant, as is generally preferred, or varies (regularly or irregularly) in a way which provides the same functionality, and optionally the same appearance, as a constant cross section.

Pedestal Bases and Support Members for Use in the First Preferred Aspect of the Invention.

The pedestals of the first preferred aspect of the invention include a pedestal base and a plurality of support members, both as defined above. In some embodiments, the pedestal base and/or the support members are for example as disclosed in Publication No. US 2004/0124324 or one of the other documents incorporated by reference herein. In other embodiments, the pedestal base comprises a base component according to the fourth preferred aspect of the invention.

The support members can have any cross section which enables them to be slidably fitted into the open channels of the pedestal base. Preferably, each of the support members has the same cross-section throughout its length. Preferably, each of the support members is straight throughout its length. Preferably all the support members have the same cross-section. Preferably the support members have a cross-section having three or more equal sides so that it is not necessary to rotate the member in order to achieve the right orientation for the open channel, for example a square, hexagonal or octagonal cross-section. It is also preferred, in order to enhance the lateral stability of the support members after they have been placed in the open channels, that each side of the support member has a vertical section adjacent to a vertical section of the channel. A square cross-section is particularly preferred. When the support member has a square cross-section, each side of the square can for example be 0.25 to 3, or 0.25 to 2, preferably 0.5 to 1.5 inch long. When the support member has a cross-section other than a square cross-section, the peripheral length of the cross section can for example be 0.75 to 12, preferably 2 to 6, inches Block Components The pedestals of the first preferred aspect of the invention include a block component as defined in the first preferred aspect of the invention, and that block component can optionally be a novel block component according to the second preferred aspect of the invention. All the block components have a bottom surface which comprises at least one recessed section and at least one projecting section. The novel block components have a top surface which comprises at least one recessed section and at least one projecting section, and which preferably comprises comprising a plurality of block channels.

In some embodiments, the pedestal includes first and second novel block components, which may be the same or different, and a plurality of horizontal upper support members, each upper support member being slidably fitted into a block channel in the first block component and a block channel in the second block component. The upper support members can for example be at an angle, preferably a right angle, to the lower support members. In some embodiments, at least some, preferably all, of the upper support members are the same as at least some, preferably all, of the lower support members. In some embodiments, at least one, preferably all, of the upper support members and/or at least one, preferably all, of the lower support members are as disclosed in application Ser. No. 10/734,868 (Publication No. US 2004/0124324). In some embodiments, at least two, preferably all, of the upper support members and/or at least two, preferably all of the lower support members extend upward from the channels in which they are fitted, so that one or more additional block components and/or one or more pedestal bases as disclosed in application Ser. No. 10/734,868 (Publication No.

US 2004/0124324) can be slidably located on the upwardly extending portions of the support members.

Optional Features of the Bottom Surface of the Block Component

The bottom surface of the block component can optionally have one or more of the following features.

(A1) It comprises a single elongate projecting section and two elongate recessed sections, one on each side of the projecting section, so that the component can be slidably fitted over a pair of adjacent straight and parallel support members, with the projecting section between the support members and the recessed sections resting on the support members.

(A2) It comprises a plurality of projecting sections, the number of projecting sections being n, and a plurality of recessed sections, the number of recessed sections being from n−1 to n+2, so that the component can be fitted, preferably slidably fitted, over a plurality of adjacent straight, parallel and equispaced support members, with at least some of the projecting sections extending downwards between a pair of adjacent support members and at least some of the recessed sections resting on a support member. In one embodiment, there are two projecting sections, and three recessed sections, and the projecting sections are positioned and shaped so that the block components can be placed in a number of different orientations over a plurality of parallel straight support members, for example so that the channels in the block component are at right angles to, or parallel to, or at an angle (e.g. about 45°) to, the support members. The projecting sections can for example have a round cross-section, or a regular polygonal, e.g. octagonal, cross-section.

(A3) It comprises two projecting sections and a single recessed section between the two projecting sections, so that the component can be slidably fitted over a single straight support member or over a plurality of straight and parallel support members, with the recessed section resting on the support member or support members, and the projecting sections extending downwards adjacent to the side of a support member.

(A4) The bottom surface of the component comprises a single projecting section and two elongate recessed sections, one on each side of the projecting section, the projecting section having a cross-section, e.g. a round cross-section, which enables it to rotate and to slide between a pair of adjacent straight and parallel support members, so that the component can be slidably and rotatably fitted over a pair of adjacent straight and parallel support members, with the projecting section between the support members and the recessed sections resting on the support members. The ability of the component to rotate can be through 360° or through some smaller angle, and the component can comprise stops or other means which enable a user to set the angle at a desired value and/or to recognize when the angle is at a desired value.

(A5) It is such that the component can be slidably fitted over a support member or a plurality of support members as disclosed in application Ser. No. 10/734,868 (Publication No. US 2004/0124324).

(A6) The projecting section or, if there is a plurality of projecting sections, at least one of the projecting sections, can be removed from the remainder of the intermediate component, and can optionally be replaced in the same or a different location in the intermediate component.

Optional Features of the Top Surface of the Block Component

In the pedestals of the first preferred aspect of the invention, the top surface of the block component can be of any kind. It can for example be planar, e.g. so that it can support tableware, or it can have a non-planar configuration which fulfills a desired functional or decorative purpose. In the preferred novel block components of the second preferred aspect, the top surface comprises a plurality of block channels such that horizontal upper straight support members can be placed parallel to each other in the block channels. The block channels can for example have one or more of the following characteristics.

(B1) They are shaped and located so that it is possible to place a plurality of upper support members in the block channels so that the upper support members are at an angle, preferably at a right angle, to the lower support member or members over which the bottom surface of the component can be fitted; for example the block channels are at right angles to the projecting section or sections forming part of the bottom surface of the component.

(B2) The distance between the block channels is substantially the same as the width of the projecting section or sections on the bottom surface.

(B3) The height and/or width of the block channels in the top surface is substantially the same as the height and/or width of the recesses in the bottom surface.

(B4) At least some, preferably all, of the block channels are such that support members as disclosed in application Ser. No. 10/734,868 (Publication No. US 2004/0124324) can be slidably fitted therein.

(B5) There are 2 to 8, e.g. 3 to 6, for example 5, channels.

(B6) They are rectangular (including square) in cross-section.

(B7) The block channels are sized and positioned, and the bottom surface of the component is configured, so that, if two upper support members are placed in two adjacent block channels, an identical block component can be slidably fitted over two upper support members.

Other Optional Features of the Block Component (C1) The component has block channels in its upper surface and has at least one of the following features (i) a core cross-section which is rectangular (including square), (ii) the ratio of the width to the height of the core cross section is from 0.5:1 to 1:40, e.g. 1:1 to 1:6, for example 1.5:2 to 1:4, (iii) the area of the core cross section is 2 to 16, for example 3 to 8, in.$^2$, and (iv) the component is 3 to 20 inches, e.g. 4 to 10 inches, long, and/or 1 to 6 inches, e.g. 1.5 to 3 inches wide, and/or 0.5 to 8 inches, e.g. 1 to 4 inches high.

(C2) The component does not have block channels in its upper surface and has at least one of the following features (i) a core cross-section which is rectangular, (ii) the ratio of the width to the height of the core cross section is from 4:1 to 40:1, e.g. 10:1 to 30:1, for example 6:1 to 2:1, (iii) the area of the core cross section is 2 to 16, for example 3 to 8, in.$^2$, and (iv) the component is 3 to 20 inches, e.g. 4 to 10 inches, long, and/or 1 to 6 inches, e.g. 1.5 to 3 inches wide, and/or 0.5 to 8 inches, e.g. 1 to 4 inches high.

(C3) The sides of the component are free of channels.

(C4) The component comprises (i) a bottom portion which provides the bottom surface, and (ii) a top portion which provides the top surface and which is rotatably connected to the bottom portion, so that when the bottom portion is fitted over one or more support members, the top portion can be rotated relative to the bottom portion. The ability of the top and bottom portions to rotate can be through 360° or through some smaller angle, and the component can comprise stops or other means which enable a user to set the angle at a desired value and/or to recognize when the angle is at a desired value.

Pedestals.

One example of a pedestal according to the first aspect of the invention is a pedestal wherein (A) the pedestal base comprises one or more pedestal bases, e.g. a pedestal base as disclosed in US Publication No. 2004/0124324, (B) the number of the pairs of base channels in each pedestal base is from 3 to 6;

(C) the number of the lower support members is from 3 to 6;

(D) each of the lower support members is a straight support member slidably fitted into one of the pairs of base channels;

(E) all the lower support members have the same cross section; and (F) the top surfaces of all the lower support members lie in the same horizontal plane.

Another example of a pedestal according to the first aspect of the invention is a pedestal which comprises (A) a pedestal comprising first and second spaced-apart wall members, each wall member having a horizontal upper surface which defines 3-6 open base channels, the open base channels defining 3-6 pairs of open base channels, each pair comprising an open base channel in the first member and an open base channel in the second member;

(B) 3-6 straight lower support members which are (i) parallel to each other, (ii) have top surfaces which lie in the same horizontal plane, and (iii) have the same cross section; each lower support member being slidably fitted into one of the pairs of open base channels, with a midsection of the lower support member lying between the base channels and having an open space underneath it;

(C) a block component which has (i) a substantially constant, generally rectangular core cross-section, and (ii) top and bottom surfaces, the bottom surface comprising two recessed sections and a projecting section, the projecting section lying between two adjacent lower support members and the recessed sections resting on the two adjacent lower support members, and the top surface comprising a plurality of open block channels; and (D) 3-6 straight upper support members which are (i) placed parallel to each other in the block channels, (ii) are at right angles to the lower support members, (iii) have top surfaces which lie in the same horizontal plane, and (iv) have the same cross section, each of a support member being slidably fitted into one of the block channels.

Such a pedestal can for example further comprise (E) a third wall member which is higher than the first and second wall members and has a horizontal upper surface which defines a plurality of open base channels into which are slidably fitted the upper support members.

Alternatively or additionally, such a pedestal can for example further comprise (F) a second pedestal base which comprises third and fourth spaced-apart wall members, each wall member having a horizontal upper surface which defines 3-6 additional open base channels, the additional open base channels defining 3-6 pairs of open base channels, each pair comprising an open base channel in the third member and an open base channel in the fourth wall member;

(G) 3-6 straight additional support members which are (i) parallel to each other, (ii) have top surfaces which lie in the same horizontal plane, and (iii) have the same cross section; each additional support member being slidably fitted into one of the pairs of open base channels defined by the third and fourth wall members, with a midsection of the additional support member lying between the base channels and having an open space underneath it;

(H) a second block component which has (i) a substantially constant, generally rectangular core cross-section, and (ii) top and bottom surfaces, the bottom surface comprising two recessed sections and a projecting section, the projecting section lying between two adjacent additional support members and the recessed sections resting on the two adjacent additional support members, and the top surface comprising a plurality of open block channels into which are fitted the upper support members.

The Third and Fourth Preferred Aspects of the Invention

The fourth preferred aspect of the invention is a base component for a pedestal, for example a pedestal according to the third preferred aspect of the invention. The base component has an upper surface which includes a plurality of base channels. The bottom surface of the base component can be planar, so that it can be placed on a flat horizontal surface, or can be configured so that it is located on top of other components of a pedestal. The base channels serve to locate pedestal components which are placed on top of the base component, for example block components as discussed above.

The base components of the fourth aspect of the invention can optionally have one or more of the following characteristics.

(D1) Each of the length l and the width w is at least 20 times, e.g. at least 40 times, the thickness h.

(D2) It is sufficiently rigid to remain substantially planar when it is placed on an irregular generally horizontal surface.

(D3) The base channels have a depth substantially equal to the depth of a projecting section on the bottom surface of a block component, or a lesser depth, for example 0.04 to 0.25 inch, e.g. 0.04 to 0.125 inch In the fifth preferred aspect of the invention, the components can be packed into any suitable container, optionally having compartments for different components, for example a box or a bag, for example a cardboard box or fabric bag. The components can be selected so that they can be assembled into a wide variety of pedestals of different functionalities, shapes, dimensions and decorative appearances. The invention makes it possible for users to transport a kit of relatively small dimensions to, for example, a particular catering or display event, and to construct, on site, one or more pedestals adapted to the particular requirements of the event. The components are preferably such that, after the event, they can be easily disassembled, cleaned (for example in commercial washing facilities) and repacked as a compact kit for transport to storage or to another event.

Figure 4:
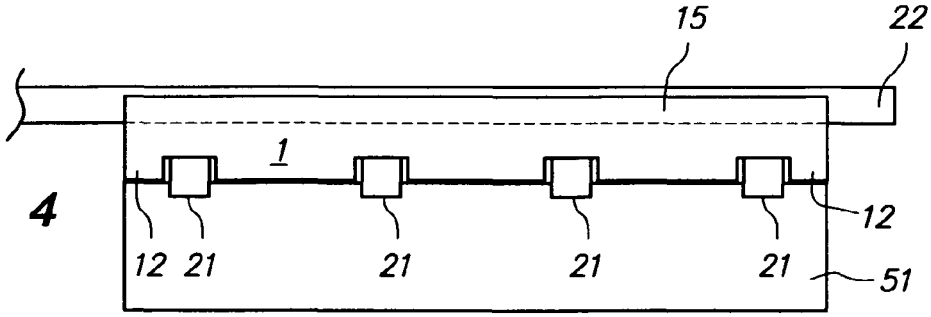
Figure 5:
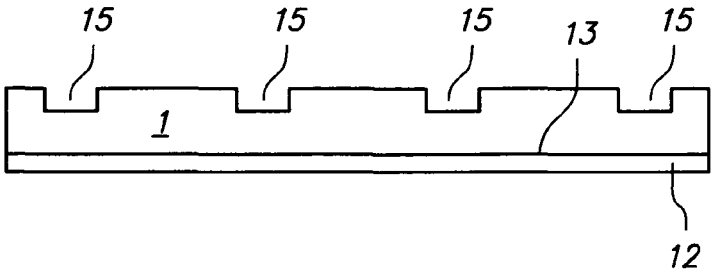
FIG. 5 is a side view of the block component shown in FIG. 1.
Figure 6:
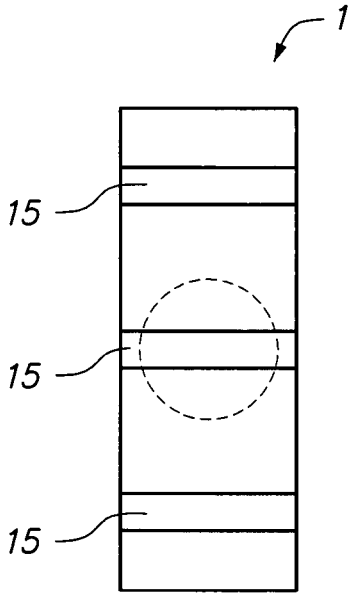
FIGS. 6 and 7 are plan and side views of another block component according to the second preferred aspect of the invention which can be slidably and rotatably fitted over a pair of support members.
Figure 7:
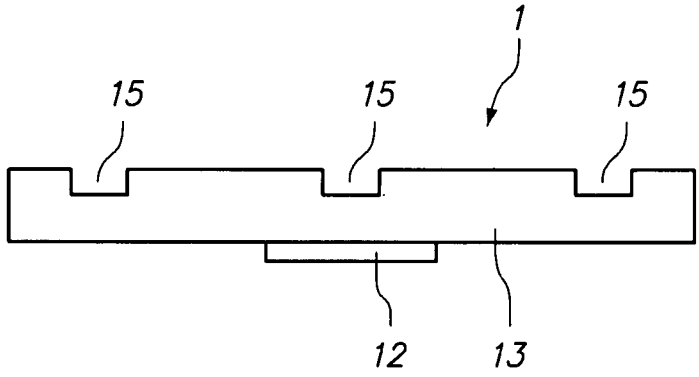
Figure 8:
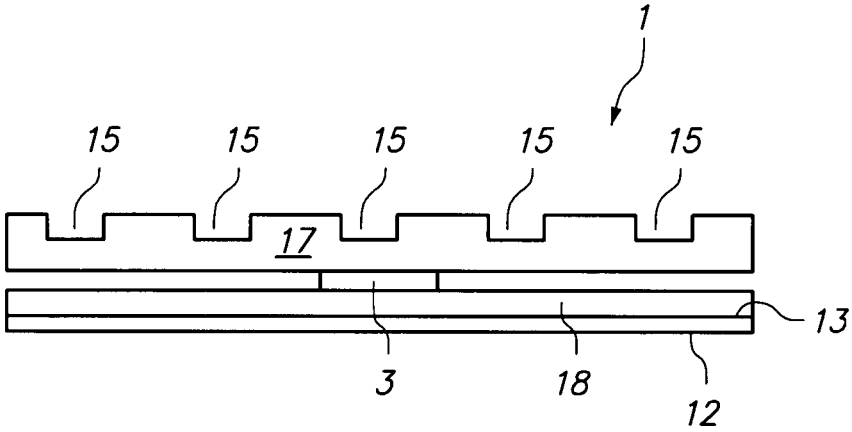
FIG. 8 is a plan view of another block component according to the second preferred aspect of the invention having two portions which can be rotated relative to each other.
Figure 9:
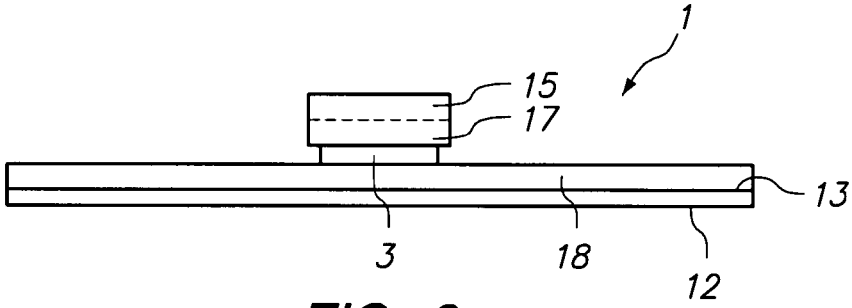
FIG. 9 is a plan view of the component of FIG. 8 after the upper portion has been rotated through 90°.
Figure 10:
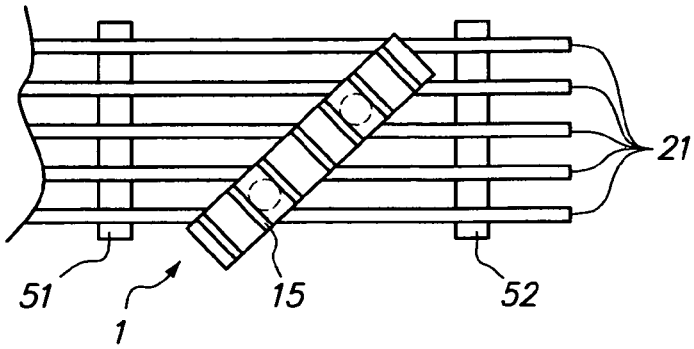
FIGS. 10-12 are plan views of three different pedestals according to the first preferred aspect of the invention; each pedestal includes a set of lower support members fitted into base channels of a pedestal base and a block component of the invention which is fitted over the lower support members in a different way in each of the Figures
Figure 11:
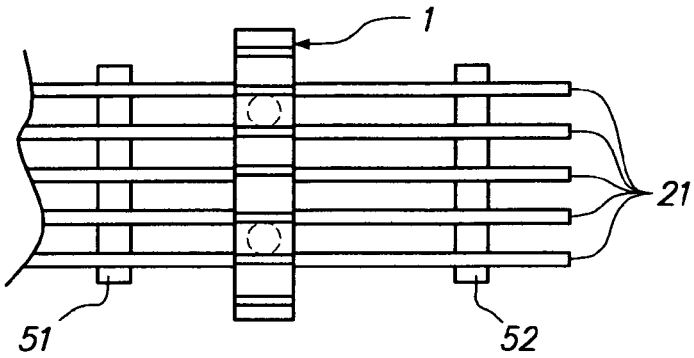
Figure 12:
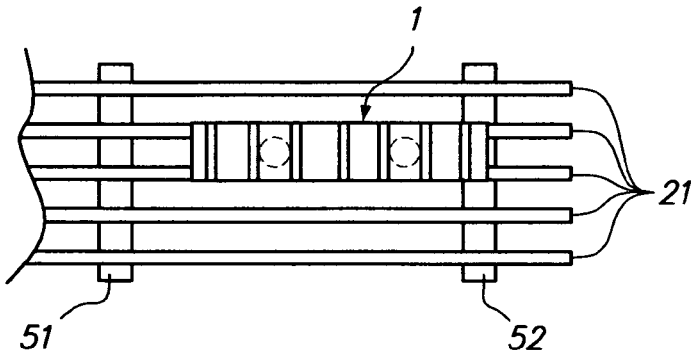
Figure 13:
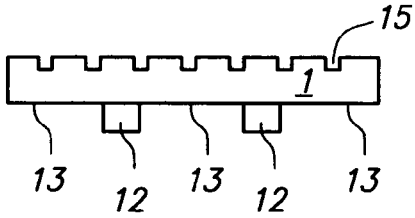
FIGS. 13 and 14 are side and end views of the block component shown in FIGS. 10-12.
Figure 14:
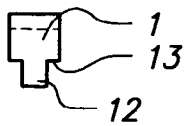
Figure 15:
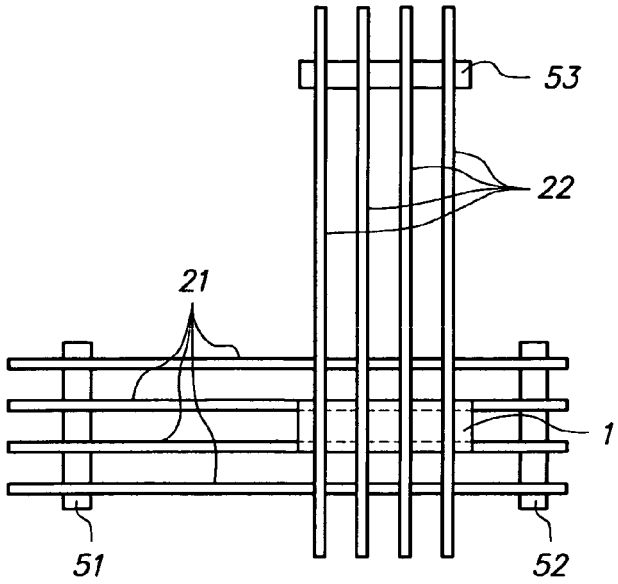
FIGS. 15, 16 and 17 are plan, side and end views of a pedestal according to the first preferred aspect of the invention.
Figure 16:
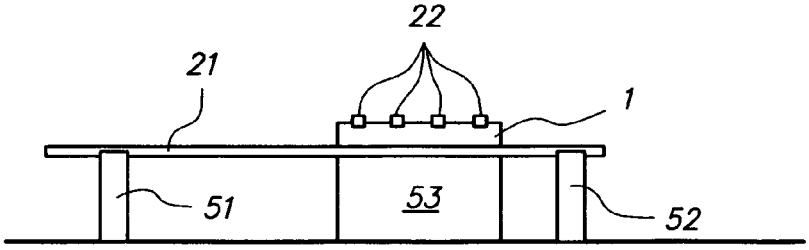
Figure 17:
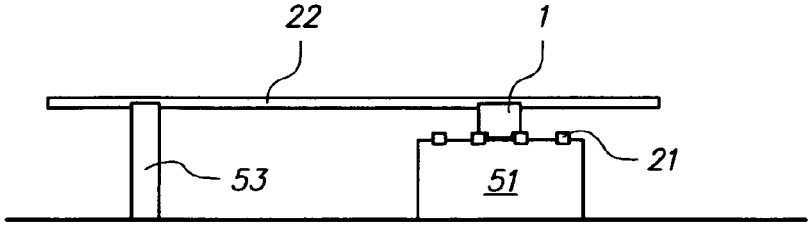
Figure 18:
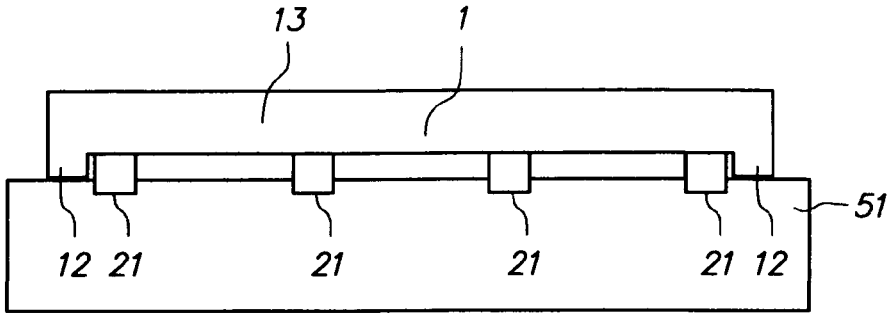
FIGS. 18 and 19 are side and end views of another pedestal according to the first preferred aspect of the invention, with lower support members fitted into base channels of a pedestal base, and a block component fitted over the lower support members.
Figure 19:
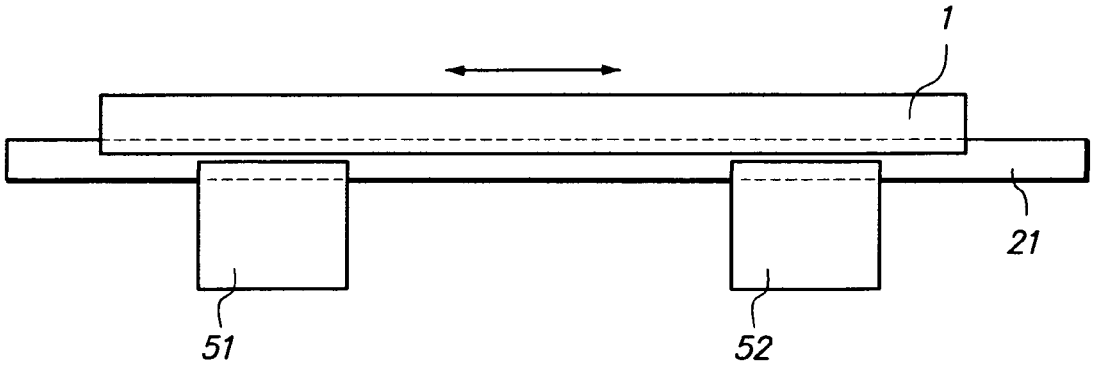

Reference is now made to the Figures, in which the same reference numerals are used to denote the same or similar features. Each of FIGS. 1-17 and 20-22 shows a block component 1 according to the second preferred aspect of the invention and which has a top surface comprising a plurality of channels 15 and a bottom surface comprising one or more recessed sections 13 and one or more projecting sections 12. FIGS. 18 and 19 show a block component having a planar top surface and a bottom surface having a single recessed section 13 and two projecting sections 12. In FIGS. 1-4, the block component is slidably fitted over a set of parallel straight lower support members 21, which are fitted into base channels of a pedestal base. The pedestal base is configured so that a midsection of each of the lower support members lies between a pair of base channels and has an open space underneath it. The pedestal base can for example comprise (i) a hollow tube having a substantially horizontal upper peripheral surface which defines the base channels and a substantially horizontal low peripheral surface, or (ii) two separate wall members, as in FIGS. 10-12 and 15-19. In FIGS. 10-12 and 15-19 the block component is slidably fitted over a set of parallel straight lower support members 21 which are fitted into base channels of a pedestal base made up of two separate wall members 51, 52. In FIGS. 4 and 18, the two central lower support members 21 could be omitted without changing the functioning of the block component 1, but might be useful for other purposes. In FIGS. 20-22, the block component is slidably fitted into channels of a base component 5 according to the fourth preferred aspect of the invention, thus forming (together with the base component 5 and the upper support members 22) a pedestal according to the third preferred aspect of the invention. In FIGS. 1-4, 15-16 and 20-22, a set of parallel straight upper support members 22 is slidably located in the channels 15. In FIGS. 8 and 9, the block component includes an upper portion 17 and a lower portion 18, the portions 17 and 18 being rotatably connected to each other through connection 3. In FIGS. 10-14, the block component has two projecting sections 12, each of circular cross-section, spaced-apart from each other so that the block component can be placed on the same set of support members in three different orientations, with the block channels of the block component being parallel to, at right angles to, or at an angle of about 45° to, the lower support members. In FIGS. 15-17, the lower support members 21 are slidably supported by a pedestal base comprising two separate wall members 51 and 52 each having base channels in the upper surface thereof, and one end of the set of upper support members 22 is slidably supported by a wall member 53. In FIGS. 18 and 19, the block component has a top surface which is substantially planar.

What is claimed is:

1. A pedestal which comprises (1) a pedestal base having a horizontal upper surface, the upper surface, defining at least two pairs of open base channels, each pair of open base channels being sized and spaced so that a straight lower support member of constant cross section can be slidably fitted into the pair of base channels, with a midsection of the lower support member lying between the base channels and having an open space underneath it, and the pairs of base channels being placed so that, when a straight lower support member is fitted into each pair of base channels, the support members are horizontal and parallel to each other;

(2) a plurality of horizontal straight parallel lower support members, each lower support member being slidably supported by one of the pairs of base channels; and (3) a block component which has (i) a substantially constant, generally rectangular core cross-section, and (ii) top and bottom surfaces, the bottom surface comprising at least one recessed section and at least one projecting section, the recessed and projecting sections being shaped and located so that the block component fits slidably over at least one of the lower support members.

2. A pedestal according to claim 1 which comprises (a) first and second said block components, the top surface of each of the block components comprising a plurality of open block channels; and (b) at least two straight upper support members, the upper support members being parallel to each other, and each upper support member being slidably supported by fitted-into a first block channel in the first block component and a second block channel in the second block component.

3. A pedestal according to claim 1 wherein the block component is fitted over at least two of the lower support members, and the top surface of the block component is substantially planar.

4. A pedestal according to claim 1 wherein the top surface of the block component is selected from (i) a mirror image of the bottom surface, and (ii) a laterally displaced mirror image of the bottom surface.

5. A pedestal according to claim 1 which comprises at least three lower support members, and wherein the top surface of the block component comprises a plurality of block channels and the bottom surface of the block component consists essentially of two projecting sections and three recessed sections, such that the block component can be placed in a plurality of different orientations on the lower support members.

6. A pedestal according to claim 1 wherein (a) the bottom surface of the block component comprises a single projecting section, and (b) the single projecting section is slidably and rotatably fitted between two lower support members.

7. A pedestal according to claim 1 wherein the block component comprises (i) a bottom portion which provides the bottom surface, and (ii) a top portion which provides the top surface and which is rotatably connected to the bottom portion.

8. A pedestal according to claim 1 wherein (A) the pedestal base comprises one or more pedestal bases, each of said pedestal bases being selected from (1) pedestal bases which comprise a hollow tube having a substantially horizontal upper peripheral surface which defines the pairs of base channels and a substantially horizontal lower peripheral surface, (2) pedestal bases which comprise two spaced-apart wall members, each wall member having one of the base channels of each pair of base channels, (3) pedestal bases which comprise an undulating upper surface which includes the pairs of base channels, and (4) pedestal bases which comprise two or more separably interlocking wall members;

(B) the number of the pairs of base channels in each pedestal base is from 3 to 6;

(C) the number of the lower support members is from 3 to 6;

(D) each of the lower support members is a straight support member slidably supported by one of the pairs of base channels;

(E) all the lower support members have the same cross section; and (F) the top surfaces of all the lower support members lie in the same horizontal plane.

9. A pedestal according to claim 1 wherein (1) the top surface of the block component is free from channels, (2) the bottom surface of the block component comprises two projecting sections and a single recessed section between the two projecting sections, (3) the block component has a rectangular core cross-section which (i) has a width and height such that the ratio of the width to the height is from 4:1 to 40:1 and (ii) an area of 2 to 16 in.$^2$, and (4) the block component is 3 to 20 inches long.

10. A pedestal according to claim 1 wherein (1) the top surface of the block component is free from channels, (2) the bottom surface of the block component comprises two projecting Sections and a single recessed section between the two projecting sections, (3) the block component has a rectangular core cross-section which (i) has a width and height such that the ratio of the width to the height is from 10:1 to 30:1 and (ii) an area of 3 to 8 in.$^2$, and (3) the block component is 3 to 20 inches long.

11. A pedestal according to claim 1 wherein each of the support members is straight and has the same cross-section throughout its length.

12. A pedestal according to claim 1 wherein each of the support members is straight throughout its length and has a square cross-section.

13. A pedestal which comprises (A) a pedestal base which comprises first and second spaced-apart wall members, each wall member having a horizontal upper surface which defines 3-6 open base channels, the open base channels defining 3-6 pairs of open base channels, each pair of open base channels (i) comprising an open base channel in the first member and an open base channel in the second member, and (ii) being sized and spaced so that a straight lower support member of constant cross section can be slidably fitted into the pair of open base channels, with a midsection of the lower support member lying between the base channels and having an open space underneath it, and the pairs of base channels being placed so that, when a straight lower support member is fitted into each pair of base channels, the support members are horizontal and parallel to each other;

(B) 3-6 straight lower support members which are (i) parallel to each other, (ii) have top surfaces which lie in the same horizontal plane, and (iii) have the same cross section; each lower support member being slidably supported by one of the pairs of open base channels, with a midsection of the lower support member lying between the base channels and having an open space underneath it;

(C) a block component which has (i) a substantially constant, generally rectangular core cross-section, and (ii) top and bottom surfaces, the bottom surface comprising two recessed sections and a projecting section, the projecting section lying between two adjacent lower support members and the recessed sections resting on the two adjacent lower support members so that the block component fits slidably over the lower support members, and the top surface comprising a plurality of open block channels; and (D) 3-6 straight upper support members which are (i) placed parallel to each other in the block channels, (ii) are at right angles to the lower support members, (iii) have top surfaces which lie in the same horizontal plane, and (iv) have the same cross section, each of the upper support members being slidably supported by one of the block channels.

14. A pedestal according to claim 13 which further comprises (E) a third wall member having a horizontal upper surface which defines a plurality of open base channels, which slidably support the upper support members.

15. A pedestal according to claim 13 which further comprises (F) a second pedestal base which comprises third and fourth spaced-apart wall members, each wall member having a horizontal upper surface which defines 3-6 additional open base channels, the additional open base channels defining 3-6 pairs of open base channels, each pair comprising an open base channel in the third member and an open base channel in the fourth wall member;

(G) 3-6 straight additional support members which are (i) parallel to each other, (ii) have top surfaces which lie in the same horizontal plane, and (iii) have the same cross section; each additional support member being slidably supported by one of the pairs of open base channels defined by the third and fourth wall members, with a midsection of the additional support member lying between the base channels and having an open space underneath it;

(H) a second block component which has (i) a substantially constant, generally rectangular core cross-section, and (ii) top and bottom surfaces, the bottom surface comprising two recessed sections and a projecting section, the projecting section lying between two adjacent additional support members and the recessed sections resting on the two adjacent additional support members, and the top surface comprising a plurality of open block channels which slidably support the upper support members.

16. A pedestal which comprises (A) a pedestal base which comprises first and second spaced-apart wall members, each wall member having a horizontal upper surface which defines 3-6 open base channels, the open base channels defining 3-6 pairs of open base channels, each pair of open base channels (i) comprising an open base channel in the first member and an open base channel in the second member, and (ii) being sized and spaced so that a straight lower support member of constant cross section can be slidably fitted into the pair of open base channels, with a midsection of the lower support member lying between the base channels and having an open space underneath it, and the pairs of base channels being placed so that, when a straight lower support member is fitted into each pair of base channels, the support members are horizontal and parallel to each other;

(B) 3-6 straight lower support members which are (i) parallel to each other, (ii) have top surfaces which lie in the same horizontal plane, and (iii) have the same cross section; each lower support member being slidably supported by one of the pairs of open base channels, with a midsection of the lower support member lying between the base channels and having an open space underneath it; and (C) a block component which has (a) a substantially constant, generally rectangular core cross-section which (i) has a width and height such that the ratio of the width to the height is from 10:1 to 30:1 and (ii) an area of 3 to 8 in.$^2$, (b) a length of 3 to 20 inches, (c) a top surface which does not have channels in its upper surface, and (d) a bottom surface which comprises two projecting sections and a single recessed section between the two projecting sections, the recessed and projecting sections being shaped and located so that the block component fits slidably over at least two of the lower support members.

17. A pedestal according to claim 16 wherein each of the support members is straight and has the same cross-section throughout its length.

* * * * *